US005089464A

United States Patent [19]

Ichii et al.

[11] Patent Number: 5,089,464

[45] Date of Patent: Feb. 18, 1992

[54] IMAGE-RECEIVING PAPER FOR THERMAL SUBLIMABLE DYE TRANSFER

[75] Inventors: Masaru Ichii; Kozo Fukuda; Kenji Morishita, all of Tokyo, Japan

[73] Assignee: Nisshinbo Industries, Inc., Tokyo, Japan

[21] Appl. No.: 425,682

[22] Filed: Oct. 10, 1989

[51] Int. Cl.[5] ..... B41M 5/035; B41M 5/26

[52] U.S. Cl. ..... 503/227; 8/471; 428/195; 428/447; 428/913; 428/914

[58] Field of Search ..... 8/471; 428/195, 447, 428/500, 913, 914; 503/227

[56] References Cited

FOREIGN PATENT DOCUMENTS 1244589 10/1986 Japan ..... 503/227

*Primary Examiner*—Bruce H. Hess

*Attorney, Agent, or Firm*—Rogers & Killeen

[57] ABSTRACT

Image-receiving paper for thermal sublimable dye transfer comprises a polymer film or paper and an image-receiving layer which is laminated thereon and which contains as a releasing agent the product of reaction between an oxyalkylene oligomer having reactive groups and a low-molecular weight compound having reactive groups, for example, a silane coupling agent. The image-receiving paper exhibits good release properties during printing, a high print density and no fading and yellowing after printing.

11 Claims, No Drawings

IMAGE-RECEIVING PAPER FOR THERMAL SUBLIMABLE DYE TRANSFER

BACKGROUND OF THE INVENTION

The present invention relates to thermal sublimable dye transfer image-receiving paper which is useful for full-color copying of electronic images from video, television, color graphics and the like.

In thermal sublimable dye transfer, heat energy sufficient to sublimate and transfer a dye is applied to image-receiving paper and a color dye sheet which are in contact with each other. Therefore, the adhesion between the image-receiving paper and the color dye sheet is a problem, and there exist the following proposals for coping with this problem:

(a) A method in which amino-modified silicone and epoxy-modified silicone are used as a releasing agent, as disclosed in Japanese Patent Laid-Open No. 60-34898.

(b) A method in which a mixture of a polymer having release properties and a polymer having dyeing properties is used, as disclosed in Japanese Patent Laid-Open No. 63-82791.

The method (a), however, has a problem in that, since the modified silicones used each has a plurality of functional groups in its molecule and produce crosslinkages as reaction proceeds, the unstable system makes it difficult to produce image-receiving paper of uniform quality. The method (b) has a problem in that a mixture containing a releasing polymer essentially having a low level of dyeing properties generally has a tendency to reduce the density of the image formed.

SUMMARY OF THE INVENTION

Accordingly, it is an object of the present invention to provide image-receiving paper for thermal sublimable dye transfer which exhibits excellent dyeing properties and release properties and which is suitable for stable production thereof.

The present invention has been achieved with a view to resolving the above-mentioned problems, and provides image-receiving paper for thermal sublimable dye transfer comprising a base material and an image-receiving layer which is laminated on the surface of the base material and which is dyed with a sublimable dye, being characterized by the image-receiving layer containing as a releasing agent the product of the reaction between an oxyalkylene oligomer having reactive groups and a low-molecular weight compound having reactive groups.

The image-receiving paper of the present invention has an image-receiving layer which contacts with an color dye sheet and which contains as a releasing agent the product of the reaction between an oxyalkylene oligomer having reactive groups and a low-molecular weight compound having reactive groups so that the property in terms of release from the color dye sheet is improved.

DETAILED DESCRIPTION OF THE INVENTION

The present invention will be described in detail below.

The image-receiving paper to which the present invention is applied comprises:

(1) a base material and an image-receiving layer which is provided directly thereon; or (2) a base material, an image-receiving layer and an intermediate layer having an opaque function, whitening function, cushioning function or the like.

The image-receiving layer contains resin which is easily dyed with a sublimable dye. Although polyvinyl chloride, polyvinyl acetal or the like is used as the resin, a saturated polyester compolymer is the most preferable from the viewpoints of dyeing density and the preservation stability.

On the other hand, the components of the releasing agent are an oxyalkylene oligomer having reactive groups and a low-molecular weight compound having reactive groups. Of these components, the oxyalkylene oligomer having reactive groups has as its reactive groups amino groups, epoxy groups, hydroxyl groups, carboxyl groups or the like; and as the oxyalkylene ethylene, propylene, tetramethylene, hexamethylene or the like, both of which are ether-bonded singly or in a mixture. The oxyalkylene oligomer may contain some ester bonds or substituents in an amount which causes no deterioration in the effect, as occasion demands.

The molecular weight of the oligomer used is generally within the range of 100 to 10,000, preferably 300 to 5,000. The use of an oligomer having a low molecular weight of lower than 100 causes the deteriorations in the releasing effect which is thought to be caused by the ether chains contained in the oligomer in the present invention, and in the dispersion in a coating solution. The use of an oligomer having a high molecular weight of higher than 10,000 causes the deterioration in the preservation stability of the image formed.

Although the number of reactive groups contained in one molecule may be one or more, it is preferable to use an oligomer having two reactive groups in one molecule because, in the case of one reactive group, the stability of a coating solution is affected by the properties of other terminal groups. The use of an oligomer having 3 to 4 reactive groups in one molecule is sometimes effective in increasing and adjusting the viscosity of a coating solution. A very large number of reactive groups are, however, undesirable because crosslinking and gelation take place owing to secondary reactions.

The low-molecular weight compound having reactive groups of the components of the releasing agent preferably has reactive groups which are selected so as to react with the reactive groups in the oxyalkylene oligomer, and as a residue an alkyl group such as a methyl or 2-ethylhexyl group. However, a silane coupling agent is preferably used from the viewpoints of dispersion, release properties and stability of the image formed.

The image-receiving layer can be provided on the base material by using a normal coating method. When the coating solution is prepared, the dyeing resin serving as a main component may be dissolved in a solvent, but water is preferably used as a medium from the viewpoint of safety and health. Various additives can also be added as other components for the purpose of controlling the visco-elasticity and drying properties of the coating solution used.

When the releasing agent is added, although the two components having reactive groups may be respectively added to the coating solution, the use of the product of the reaction between the two components shows a slight change with time and enables the formation of uniform products.

DESCRIPTION OF PREFERRED EMBODIMENT

An embodiment of the present invention will be described below.

Releasing agents having the following compositions were formed.

("Parts" represents "parts by weight")

| Releasing agent | Oxyalkylene compound | Low-molecular weight compound | Reaction conditions |
|---|---|---|---|
| A | Polypropylene glycol (Mw, 2,000) 13 parts | Glycidoxypropyltrimethoxysilane 3 parts | Alkaline catalyst, 100° C., 5 hours |
| B | Tripropylene glycol diglycidyl ether, 10 parts | Aminopropyltriethoxysilane 7 parts | 30° C., 5 hours |
| C | Ethylene-propylene glycol diglycidyl ether (Mw, 500) 5 parts | Phenylamino-propyltrimethoxysilane 5 parts | 50° C., 5 hours |
| D | Polypropylene glycoltriamine (Mw, 1,200) 8 parts | Glycidoxy-propylmethyldiethoxysilane 5 parts | 30° C., 5 hours |
| E | Propylene-glycoldiamine (Mw, 2,000) 10 parts | Epoxycyclohexylethyltrimethoxysilane 5 parts | 50°C., 10 hours |

A coating solution having the composition described below was then coated on a base material (Peach Coat WE160, manufactured by Nisshinbo Industries, Inc.) and dried. Printing was then performed by using a normal color dye sheet and a 1-cm square thermal head at 120° C., and the print density and the release properties were then examined. The paper formed was then tested with respect to the degree of yellowing after it had been stored at 60° C. and a relative humidity of 100% for 3 weeks.

The properties of the coating solution were observed after being allowed to stand at room temperature for 24 hours.

| (Composition of coating solution) | |
|---|---|
| Aqueous saturated polyester copolymer resin: (Bironal MD1200, manufactured by Toyo Spinning Co., Ltd.) | 100 parts |
| Thickener: (Coracral PU'85, manufactured by BASF Co., Ltd.) | 6 parts |
| Releasing agent: | 3 parts |

In a comparative example, a mixture of 1.5 parts of amino-modified silicone (KF393 manufactured by Shin-etsu Chemical Industry Co., Ltd.) and 1.5 parts of epoxy-modified silicone (X-22343 manufactured by Shin-etsu Chemical Industry Co., Ltd.) was used as a releasing agent.

The results of the above-described tests are shown in the table given below.

| Example | Releasing agent | Stability of coating solution | Release properties | Print density | Print fading | Yellowing |
|---|---|---|---|---|---|---|
| -1 | A | ○ | ○ | ○ | ○ | ○ |
| -2 | B | ○ | ○ | ○ | ○ | ○ |
| -3 | C | ○ | ○ | ○ | ○ | ○ |
| -4 | D | ○ | ○ | ○ | ○ | ○ |
| -5 | E | ○ | ○ | ○ | ○ | ○ |
| Comparative example | Described above | Δ | ○ | ○~Δ | ○ | Δ |

In the table, "○" represents good and "Δ" represents poor.

As described above, the present invention has extremely preferable effects. Estimated effects of the invention and causes thereof are the following:

(1) The coating solution exhibits good stability.

It is though that this is because, since reaction has been previously effected, no reaction proceeds in the coating solution, and because any combination of polyfunctional compounds, which easily produce crosslinkages, is avoided from being used as a raw material.

(2) There is a thickening effect.

It is thought that this effect is caused by some association reaction between the saturated polyester copolymer of the resin and the polyether portion of the releasing agent. This thickening effect is effective to form a coating solution which is suitable for coating.

(3) The coated surface has no sticky feel.

When a general silicone releasing agent is used, the surface of the image-receiving paper has a sticky feel. It is thought that this is because of a low degree of affinity of silicone for the resin in the surface layer. It is also thought that the image-receiving paper of the present invention exhibits no stickiness because of a high degree of affinity of the releasing agent for the main resin.

(4) The release properties during printing are good.

It is thought that this is because the releasing agent itself has a low melting point and because the silane portion easily appears on the surface and has an effective releasing function, while the ether portion has high affinity for the resin.

(5) There is no occurrence of yellowing.

When an amino compound is used, the image-receiving paper formed is generally easily yellowed with the passage of time. It is thought that this is caused by free amino groups and that yellowing is significantly improved by previously reacting amino groups, as in the present invention.

(6) The releasing agent of the present invention can be also miscible with water.

The releasing agent of the present invention can be also miscible with water because of the polyether portion thereof. So the coating solution can be safe and good for health.

As described above, the function of the present invention is caused by the effective combination of the excellent affinity of the polyether chains for the resin and the releasing properties of the terminal groups derived from the silane coupling agent, and the low melting point of the releasing agent. As a result, the image-receiving paper of the present invention can be effectively used for thermal sublimable dye transfer.

What is claimed is:

1. Image-receiving paper for thermal sublimable dye transfer comprising: an image-receiving layer which is laminated on the surface of a base material so as to be dyed with a sublimable dye, said image-receiving layer containing a dyeable resin, and a releasing agent which is the product of reaction between an oxyalkylene oligomer having reactive groups and a silane coupling agent, said product of reaction comprising plural polyether chains, each having a terminal group with at least one silicon atom derived from said silane coupling agent.

2. Image-receiving paper as defined in claim 1 wherein said oxyalkylene oligomer comprises polypropylene glycol and wherein said silane coupling agent comprises glycidoxypropyltrimethoxysilane.

3. Image-receiving paper as defined in claim 1 wherein said oxyalkylene oligomer comprises the tripropylene glycol diglycidyl ether and wherein said silane coupling agent comprises aminopropyl-trimethoxysilane.

4. Image-receiving paper as defined in claim 1 wherein said oxyalkylene oligomer comprises the ethylene propylene glycol diglycidyl ether and wherein said silane coupling agent comprises phenylamino-propyltrimethoxysilane.

5. Image-receiving paper as defined in claim 1 wherein said oxyalkylene oligomer comprises the polypropylene glycoltriamine and wherein said silane coupling agent comprises glycidoxypropylmethyl diethoxysilane.

6. Image-receiving paper as defined in claim 1 wherein said oxyalkylene oligomer comprises the propylene-glycoldiamine and wherein said silane coupling agent comprises epoxycyclohexylethyltrimethoxysilane.

7. In an image-receiving paper for thermal sublimable dye transfer having an image-receiving layer laminated on a base material, said layer having a dyeable resin and a releasing agent, the improvement wherein said releasing agent comprises the product of reaction between:

(a) polypropylene glycol; and (b) glycidoxypropyl-trimethoxysilane.

8. In an image-receiving paper for thermal sublimable dye transfer having an image-receiving layer laminated on a base material, said layer having a dyeable resin and a releasing agent, the improvement wherein said releasing agent comprises the product of reaction between:

(a) tripropylene glycol diglycidyl ether; and (b) aminopropyl-trimethoxysilane.

9. In an image-receiving paper for thermal sublimable dye transfer having an image-receiving layer laminated on a base material, said layer having a dyeable resin and a releasing agent, the improvement wherein said releasing agent comprises the product of reaction between:

(a) ethylene propylene glycol diglycidyl ether; and (b) phenylamino-propyltrimethoxysilane.

10. In an image-receiving paper for thermal sublimable dye transfer having an image-receiving layer laminated on a base material, said layer having a dyeable resin and a releasing agent, the improvement wherein said releasing agent comprises the product of reaction between:

(a) polypropylene glycoltriamine; and (b) glycidoxypropyl-methyl diethoxysilane.

11. In an image-receiving paper for thermal sublimable dye transfer having an image-receiving layer laminated on a base material, said layer having a dyeable resin and a releasing agent, the improvement wherein said releasing agent comprises the product of reaction between:

(a) propylene-glycoldiamine; and (b) epoxycyclohexyl-ethyltrimethoxysilane.

* * * * *